US006811849B2

(12) United States Patent
Best

(10) Patent No.: US 6,811,849 B2
(45) Date of Patent: Nov. 2, 2004

(54) TEXTILE WEB, ESPECIALLY A TEXTILE-COVERED WEB FOR A PAPER-MAKING MACHINE

(75) Inventor: Walter Best, Duren (DE)

(73) Assignee: Thomas Josef Heimbach Gesellschaft mit Beschrankter Haftung & Co., Duren (DE)

( * ) Notice: Subject to any disclaimer, the term of this patent is extended or adjusted under 35 U.S.C. 154(b) by 111 days.

(21) Appl. No.: 09/989,719

(22) Filed: Nov. 21, 2001

(65) Prior Publication Data

US 2002/0166601 A1 Nov. 14, 2002

(30) Foreign Application Priority Data

Nov. 23, 2000 (EP) ..... 00125622

(51) Int. Cl.[7] ..... F16G 1/00; B32B 3/00

(52) U.S. Cl. ..... 428/58; 428/57; 428/192; 28/103; 28/110; 162/358.2; 112/402; 474/254; 474/258

(58) Field of Search ..... 428/57, 58, 192; 28/103, 110; 162/358.2; 112/402; 474/254, 258

(56) References Cited

U.S. PATENT DOCUMENTS

| | | | | |
|---|---|---|---|---|
| 3,767,353 A | | 10/1973 | Gaffney | |
| 3,917,889 A | | 11/1975 | Gaffney et al. | |
| 4,123,491 A | | 10/1978 | Larsen | |
| 4,698,250 A | * | 10/1987 | Talonen et al. | 428/58 |
| 4,798,760 A | * | 1/1989 | Diaz-Kotti | 428/234 |
| 4,842,905 A | * | 6/1989 | Stech | 428/33 |
| 4,913,947 A | * | 4/1990 | Nicholas et al. | 428/60 |
| 5,202,170 A | * | 4/1993 | Hsu et al. | 428/48 |
| 5,360,656 A | | 11/1994 | Rexfelt et al. | |
| 5,514,436 A | * | 5/1996 | Schlueter, Jr. et al. | 428/57 |
| 5,571,590 A | * | 11/1996 | Schultz et al. | 428/57 |
| 5,843,552 A | * | 12/1998 | Karrfalt | 428/57 |
| 6,240,608 B1 | * | 6/2001 | Paquin et al. | 28/142 |
| 6,350,336 B1 | * | 2/2002 | Paquin | 156/93 |
| 6,440,515 B1 | * | 8/2002 | Thornton et al. | 428/58 |

FOREIGN PATENT DOCUMENTS

| | | |
|---|---|---|
| EP | 0307182 | 3/1989 |
| EP | 0285376 | 1/1993 |
| EP | 0464258 | 3/1996 |
| EP | 0947623 | 10/1999 |
| GB | 975750 | 11/1964 |
| WO | WO 91/02642 | 3/1991 |
| WO | WO 92/17643 | 10/1992 |

* cited by examiner

*Primary Examiner*—Harold Pyon
*Assistant Examiner*—Brian P. Egan
(74) *Attorney, Agent, or Firm*—Liniak, Berenato & White, LLC

(57) ABSTRACT

The invention relates to a textile web, especially a textile-covered web for a paper-making machine, which, viewed from a transverse direction, is provided with several web sections (6, 7, 8, 19, 20, 27, 28) that extend parallel to one another in a lengthwise direction and are aligned adjacent to one another, with their lateral edges (9, 10, 11, 12, 21, 22, 29, 30) being attached to one another via fasteners (15, 16, 17, 18, 25, 26, 33, 34). This textile web is characterized in that the adjacent lateral edges (10, 11, 21, 22, 29, 30) follow a meandering course with alternating projections (13, 23, 31) and recesses (14, 24, 32), and the web sections (6, 7, 8, 19, 20, 27, 28) are interlocked with one another via these projections (13, 23, 31) and recesses (14, 24, 32), and in that the fasteners (15, 16, 17, 18, 25, 26, 33, 34) connect the projections (13, 23, 31) to one another.

23 Claims, 5 Drawing Sheets

Fig. 4
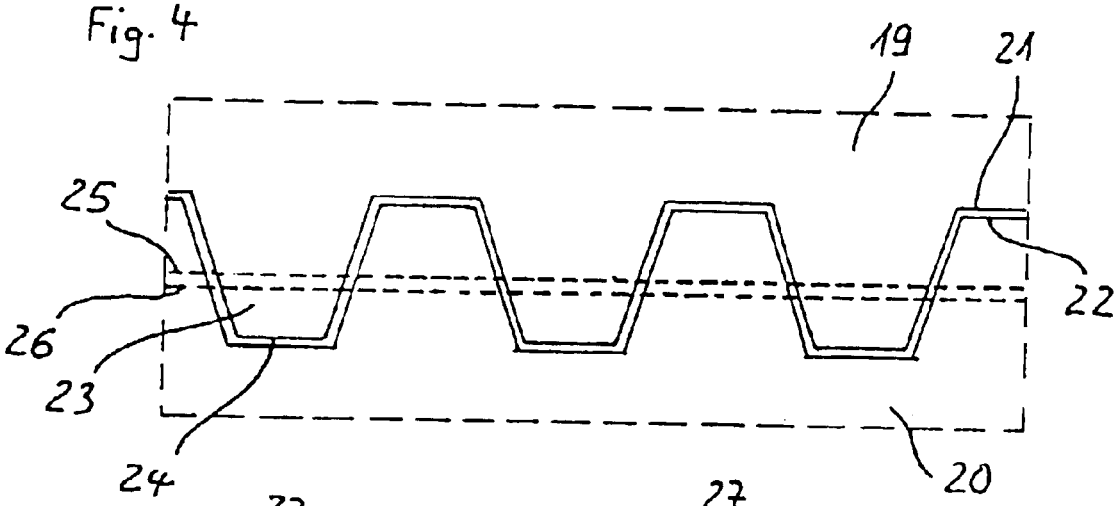
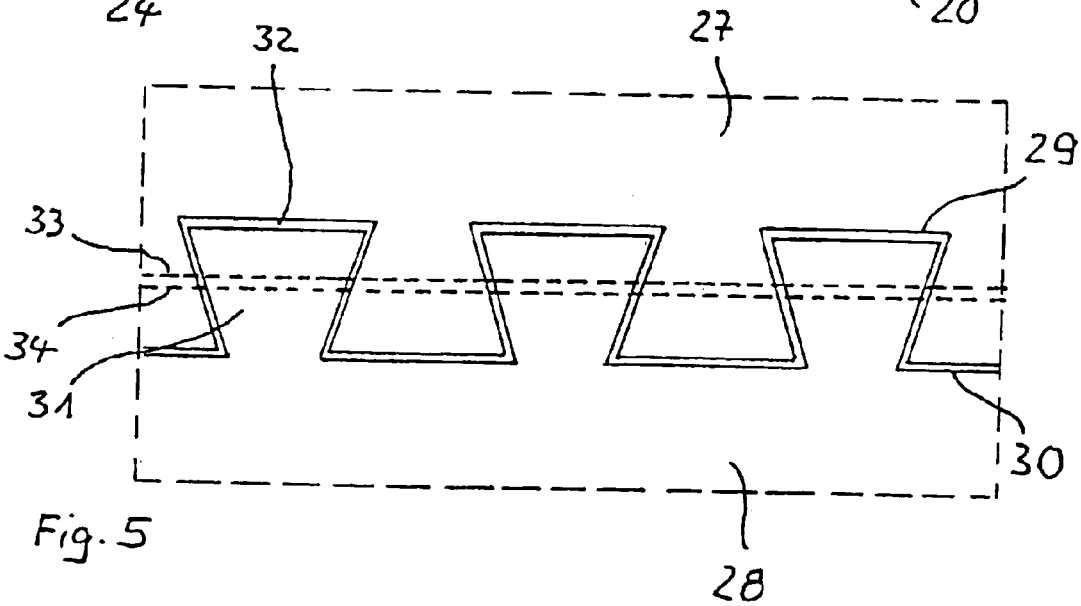
Fig. 5

TEXTILE WEB, ESPECIALLY A TEXTILE-COVERED WEB FOR A PAPER-MAKING MACHINE

BACKGROUND OF THE INVENTION

The invention relates to a textile web, especially a textile-covered web for a paper-making machine, which, viewed from a transverse direction, is provided with several web sections that extend parallel to one another in a lengthwise direction and are aligned adjacent to one another, with their lateral edges being attached to one another via fasteners.

Textile webs of the type described above are used primarily to transport paper webs through a paper-making machine (GB-A-975 750; EP-B-0 464 258; U.S. Pat. No. 5,360, 656). They are comprised of web sections extending lengthwise across the web, with the width of the sections being considerably narrower than the actual width of the textile web. The web sections extend primarily in a lengthwise direction along the textile web, sometimes at a slight angle to it. The textile web is thus designed such that one or more strips of textile are progressively wound in a lengthwise direction to the textile web, and spirally, crosswise to it.

The web sections may be comprised of structural fibers, for example in the form of a woven fabric. The structural fibers may, however, also form a support base, to which a carded fibre batt tissue is needle-punched on one or both sides, so that the final textile web forms a felt. Such felts are suited especially for use in guiding the paper web in the pressing section of a paper-making machine.

With known textile webs of this type, the individual web sections do not overlap one another, they actually push up against one another along their lateral edges. In such cases, in order to ensure adequate lateral stability, the lateral edges are connected to one another. In the abovementioned documents, it is, therefore, proposed that the lateral edges be sewn together via a zigzag stitch, that they be fused or welded, for example, by ultrasonic welding. As an alternative, the above mentioned documents propose that the lateral edges be provided with seam loops and the connection be made via a wire pushed through the seam loops.

In EP-0 947 623, a connection for the web sections is proposed, which consists of cross thread sections that project beyond the lateral edges of the web sections and overlap, interlocking with one another, and of a joining thread that is bonded to these sections. The establishment of such a connection is not without problems, however, and difficulties arise in matching the porosity of the area around the lateral edges to the porosity of the remaining areas of the web sections. In a paper-making machine it is important, however, that the porosity of the textile web be even over the entire width of the web. A further requirement is that the connection of the web sections one over the other be as firm as possible both in a crosswise and in a lengthwise direction.

SUMMARY OF THE INVENTION

The object of the present invention is to design a method for connecting the lateral edges of the web sections in a textile web of the type described at the beginning, such that it is easier to produce and possesses a high degree of stability, but its porosity does not deviate substantially from the porosity of other areas of the textile web.

This object is attained in accordance with the invention in that the adjacent lateral edges of the web sections follow a meandering course, with alternating projections and recesses, and the web sections are interlocked with one another via these projections and recesses, and in that the fasteners connect the projections to one another, in that they extend preferably in a lengthwise direction and are designed to be continuous, to the greatest extent possible.

Thus, the basic premise of the invention is that the lateral edges of the web sections are not straight—as in the current state of the art—but meander, with interlocking projections and recesses, as with toothed gears, and the connection of the adjacent web sections is accomplished via the fasteners used to connect the projections. This type of connection is relatively simple in comparison with known types of connections, and can be machine-produced. It has been found that a connection that is very firm both in a lengthwise and in a crosswise direction can be produced, without the porosity of the area around the lateral edges of the textile web deviating substantially from the porosity of other areas.

The fasteners may be designed, for example, as sewn seams, which preferably extend parallel to the lengthwise direction of the web sections, with several parallel sewn seams being provided per connection. Instead of, or in combination with, such sewn seams, sections of adhesive tape may be used, which cover the area of the projections and recesses partially or, preferably, completely, and may even extend beyond this area. In special cases, the sections of adhesive tape may contain heat-bonding adhesive, or be composed thereof. The heat-bonding adhesive may be activated via heat and pressure once the sections of adhesive tape have been put in place. In order to keep the porosity in this area from being substantially reduced, the sections of adhesive tape should be designed to be porous, in other words they should contain holes, which will ensure sufficient open crosswise surface area.

The sections of adhesive tape may be designed in many different ways. For instance, bonding sheets provided with an adhesive coating may be used, wherein the adhesive coating may consist of a suitable adhesive, such as the above mentioned heat-bonding adhesive. In order to ensure adequate porosity, the bonding sheets should be perforated.

Instead of the above, or in combination with it, the sections of adhesive tape may also be designed as spun-bonded tissue, preferably equipped with heat-bonding adhesive fibers. The advantage of using such sections of adhesive tape is that they can be cut to fit, such that they will not seriously affect the porosity of the area in question, and such that their structure will correspond to the structure of the other areas. By activating the heat-bonding fibers via heat and pressure, a firm connection between the interlocking projections is produced. The heat-bonding fibers may consist entirely of heat bonding adhesive, in which case it is advantageous for them to be present only proportionally in the non-woven tissue that forms the section of adhesive tape. They may, however, also be designed as bicomponent fibers, in which heat-bonding adhesive is proportionally present.

Regarding the meandering design of the lateral edges, various shapes are possible, for example wave-type or zigzag shapes. The projections, however, may also be trapezoidal or rectangular in shape. Other shapes for the lateral edges are also possible.

The web sections may be provided with a support base, as is known in the art, or may even be composed thereof, wherein the support base takes up the lengthwise and crosswise forces that act upon the textile web. To the extent that the textile web is to be designed as a felt, such as a press felt designed specifically for use in the pressing section of a paper-making machine, the supports may be needle-punched with spunbonded tissues, so that a felt-like surface is formed on both sides.

Suitable support bases include woven fabrics, knitted fabrics, or even reinforced spunbonded tissues, wherein the woven fabrics, knitted fabrics or spunbonded tissues are used in several layers, and may even be used in combination with one another.

Synthetic netting—in single or multiple layers, alone or in combination with the above mentioned types of support bases—may also be provided, as is described, for example, in EP-B-0 285 376, EP-A-0 307 182, WO 91/02642, or WO 92/17643. The advantage of synthetic netting is that it will edges, and thus offers a firm hold on the fasteners that extend over the projections. For this reason it is immaterial whether the individual webs of synthetic netting extend in a lengthwise or crosswise direction, or run diagonally. The synthetic netting may be produced as described in the above-named documents. One particularly efficient method for producing synthetic netting of this type consists in using extrusion technology, as is described, for example, in U.S. Pat. Nos. 4,123,491, 3,917,889, and 3,767,353.

The width of the area comprising the projections and recesses may be determined in accordance with given stability requirements. Advantageously, an area of up to 50 cm in width is suitable, with areas ranging from 10 to 20 cm being preferred.

BRIEF DESCRIPTION OF THE DRAWING

In the diagrams, the invention is described in greater detail using exemplary embodiments. These show:

FIG. 4 an overhead view of the interlocking area between two web sections, connected by a third type of connection;

FIG. 5 an overhead view of the interlocking area, with a fourth type of connection;

DETAILED DESCRIPTION OF THE PREFERRED EMBODIMENT

Figure 1:
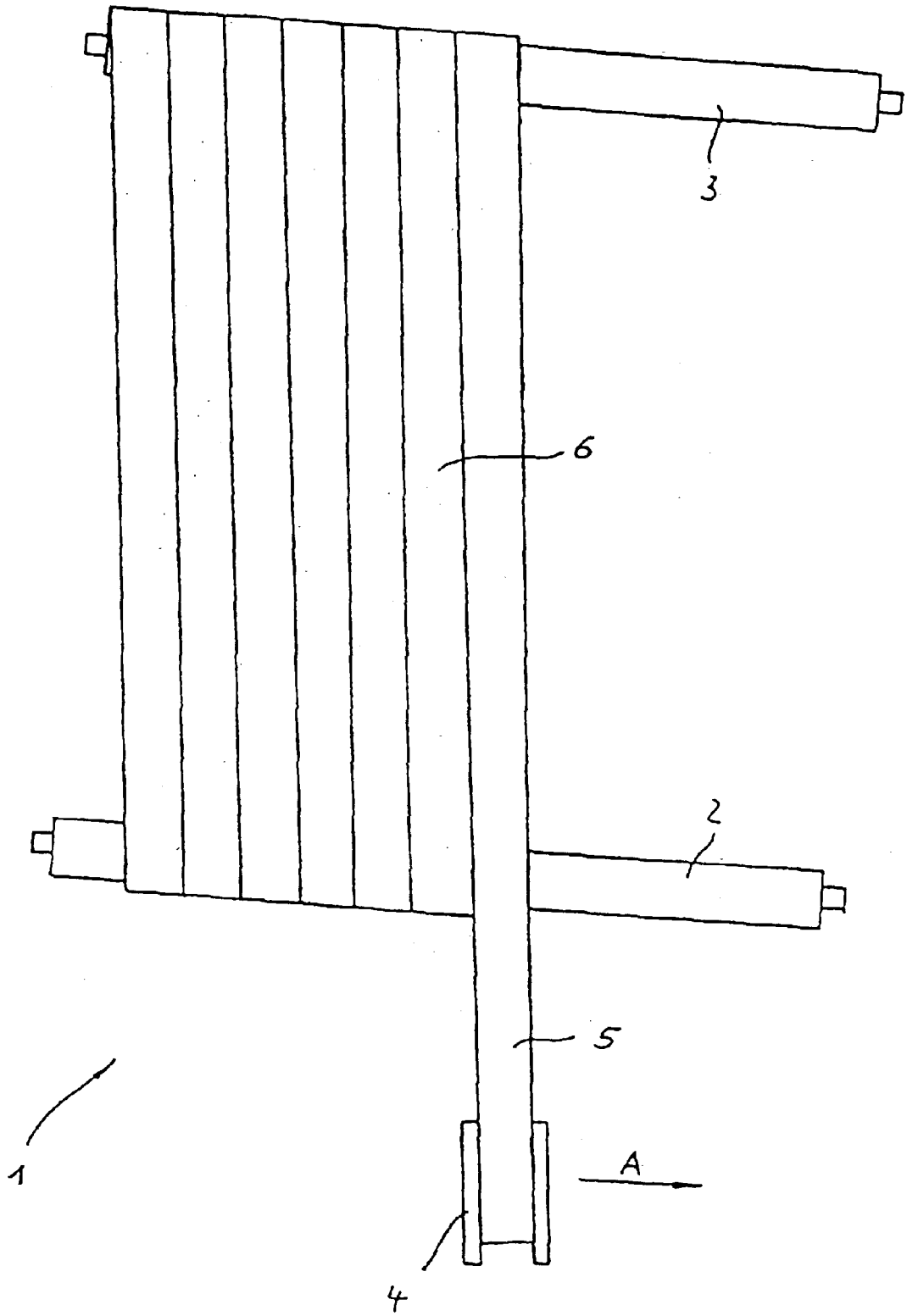
FIG. 1 an overhead view of a device used in producing a textile web with web sections.

The device 1 illustrated in FIG. 1 is equipped with two separate rollers 2, 3 driven in the same direction. A strip of textile 5 is drawn from a supply roll 4. The supply roll 4 is set at a slight angle, and when the strip of textile is drawn from it, it moves in the direction of the arrow A, in other words in a crosswise direction. This causes the strip of textile to be wound spirally onto the two rollers 2, 3, until a desired width has been reached. In this, the advance in the direction of the arrow A is calculated such that web sections—indicated here by the number 6—form, adjacent to one another, such that their lateral edges push up against one another.

The spiral rolling of the strip of textile 5 may also be performed in a number of layers, in that the supply roll 4, upon reaching the final width, is moved back, with the angle of discharge being adjusted accordingly. This is described in detail in EP-B-0 464 258 and U.S. Pat. No. 5,360,656. However, it is also possible for two loops having positive and negative angles of inclination to be positioned one above the other.

In the representation illustrated in FIG. 1, the lateral edges of the web sections 6 are shown straight for purposes of increased clarity. In FIGS. 2 through 5, various examples of lateral edge shapes are illustrated, in accordance with the invention.

Figure 2:
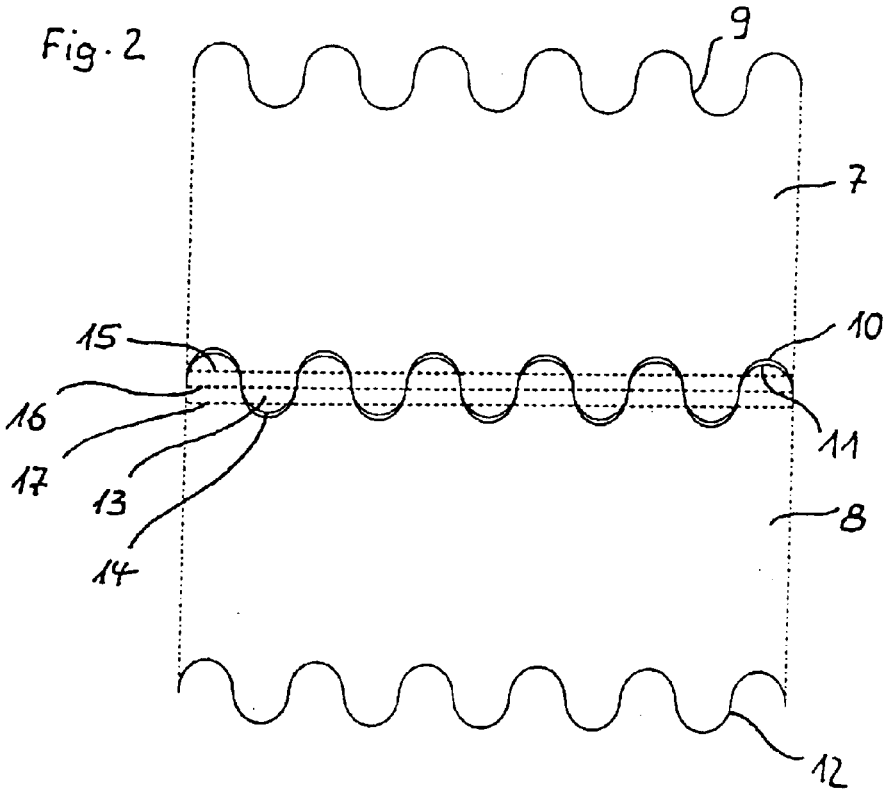
FIG. 2 an overhead view of two web sections connected by a first type of connection.

FIG. 2 shows two adjacent web sections 7, 8, whose lateral edges 9, 10, or 11, 12 are wave-like in shape, so that projections—indicated here by the number 13—and recesses—indicated here by the number 14—are produced. The web sections 7, 8 are positioned adjacent to one another such that the projections 13 and recesses 14 become interlocked with one another, in other words such that each projection 13 fits into the recess 14 the lies opposite it.

The two web sections 7, 8 are connected via three seams that run parallel to one another, extending lengthwise along the web sections 7, 8 over the projections 13, connecting them to one another. The course of the seams 15, 16, 17 ensures that the two web sections 7, 8 are firmly joined to one another.

Figure 3:
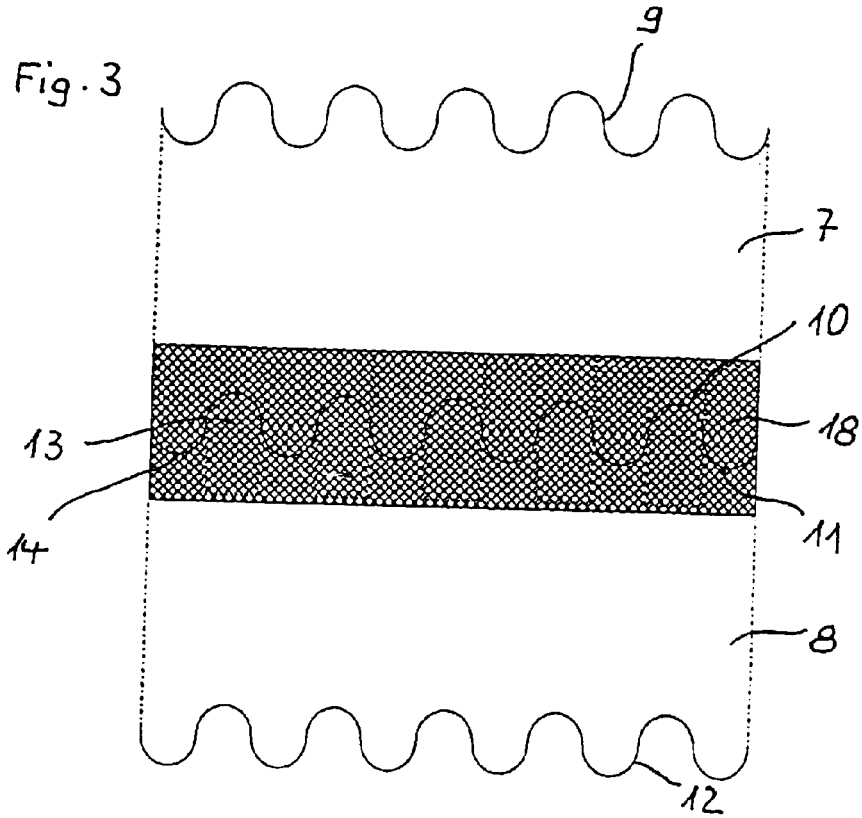
FIG. 3 an overhead view of two web sections connected by a second type of connection.

In the exemplary embodiment illustrated in FIG. 3, the same web sections 7, 8 are used, in other words they also have wave-shaped lateral edges 9, 10, 11, 12, in which projections 13 and recesses 14 are formed. In this case, instead of seams 15, 16, 17, the sections are connected via a section of adhesive tape 18, which extends in a lengthwise direction along the web sections 7, 8, and covers the area of the projections 13, 14 and the immediately adjacent areas. The section of adhesive tape 18 consists of a spunbonded tissue equipped with heat-bonding adhesive. Through the effects of heat and pressure, the heat-bonding fibers are activated, so that, once cooled, a firm connection is established between the two web sections 7, 8.

FIG. 4 shows a further embodiment of adjacent web sections 19, 20. The shape of their lateral edges 21, 22 is such that trapezoidal projections—indicated here by the number 23—and recesses—indicated here by the number 24—are formed, wherein the projections 23 become narrower as they move away from the lateral edges 21, 22 to which they are attached.

As with the exemplary embodiments illustrated in FIGS. 2 and 3, the web sections 19, 20 are positioned adjacent to one another such that the projections 23 and recesses 24 become interlocked. Two parallel seams 25, 26 extend over these projections 23, running in a lengthwise direction along the web sections 19, 20, and connecting the web sections 19, 20.

In the exemplary embodiment illustrated in FIG. 5, two web sections 27, 28 are provided, whose lateral edges 29, 30 are designed such that both trapezoidal projections—indicated by the number 31—and trapezoidal recesses—indicated by the number 32—are formed, however the width of the projections and recesses is narrower toward the lateral edges 29, 30 of the web, in contrast to the exemplary embodiment illustrated in FIG. 4. In this case as well, the web sections 27, 28 are positioned adjacent to one another such that the projections 31 and recesses 32 become interlocked. The connection is produced via two parallel seams 33, 34, which extend approximately along the center of the projections 31, joining them to one another.

Figure 6:
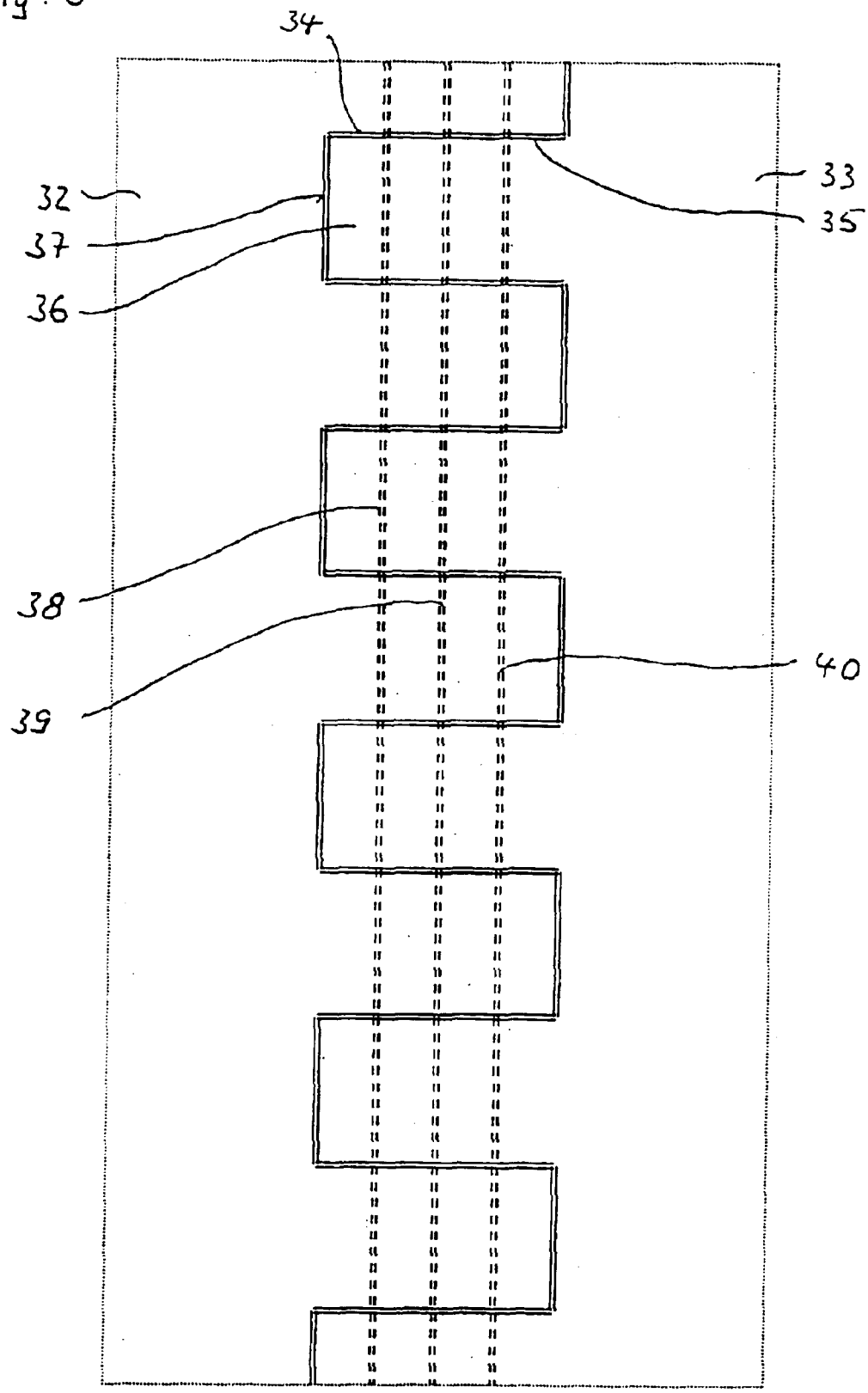
FIG. 6 an overhead view of the interlocking area with a fifth type of connection.

In the exemplary embodiment according to FIG. 6, two web sections 32, 33 are envisioned whose lateral edges 34, 35 extend in such a way that rectangular projections—indicated here as an example with the number 36—and recesses—indicated here as an example with the number 37—are produced. The web sections 32, 33 are positioned adjacent to one another is such a way that the projections 36 and recesses 37 become interlocked with one another. Three parallel seams 38, 39, 40 extend over these projections 36, running in a lengthwise direction along the web sections 32, 33 and connecting them.

It goes without saying that the connection shown in the embodiments illustrated in FIGS. 4, 5 and 6 may also be produced via a section of adhesive tape, in the manner illustrated in FIG. 3.

Figure 7:
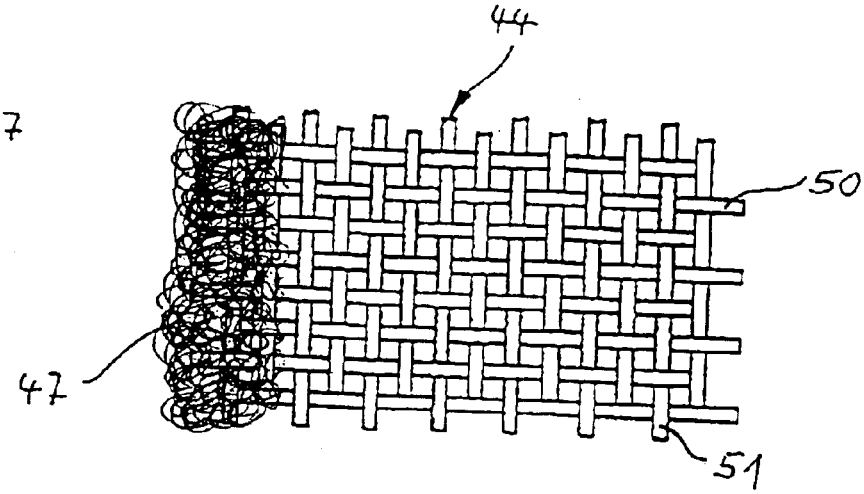
FIG. 7 an overhead view of a web section of a textile web with woven support base and needle-punched spunbonded tissue.
Figure 8:
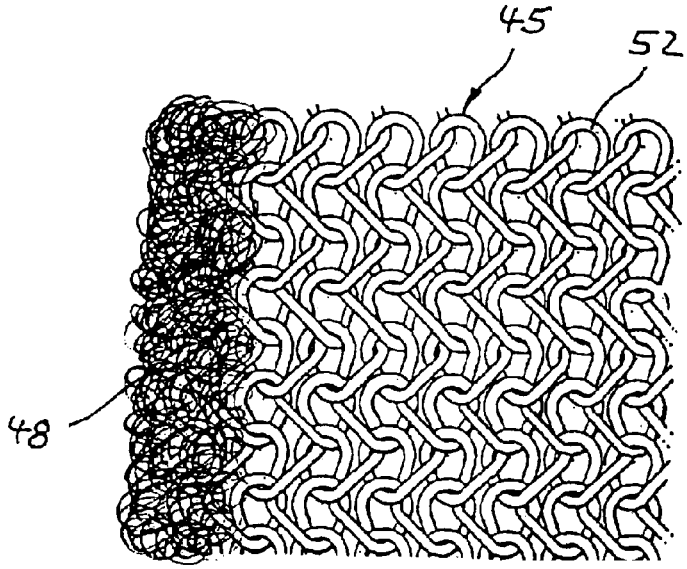
FIG. 8 an overhead view of a web section of a textile web with a knitted support base and needle-punched tissue and FIG. 9 an overhead view of a web section of a textile web with netting support base and spunbonded tissue.
Figure 9:
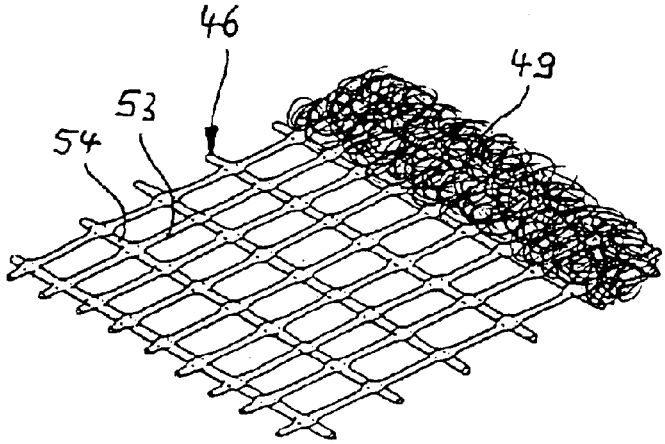

FIGS. 7, 8 and 9 show sections of web sections 41, 42, 43 in an overhead view. The web sections have a support base 44, 45, 46 to which the spunbonded tissue is needle-punched. The spunbonded tissues 47, 48, 49 were omitted in part in order to reveal that support bases 44, 45, 46 located beneath them.

In the exemplary embodiment according to FIG. 7 the support base is woven from longitudinal threads—indicated here as an example with the number 50—and cross threads—indicated here as an example with the number 51—as a basket weave. The exemplary embodiment according to FIG. 8 demonstrates a support base that is knitted from a multitude of threads—indicated here as an example with the number 52. In the exemplary embodiment according to FIG. 9 the support base 46 is comprised of an extruded netting with longitudinal wires—indicated here as an example with 53—and cross wires—indicated here with the number 54—that are connected to one another with self-substance and consisting of a suitable plastic, e.g. polyamide.

Furthermore, the present invention is not limited to spirally rolled strips of textile. The individual web sections may also be made of individual pieces positioned adjacent to one another, such that they extend not at a slight angle but precisely in a lengthwise direction.

What is claimed is:

1. Textile web, especially a textile-covered web for a paper-making machine, which, viewed from a transverse direction, is provided with several web sections (6, 7, 8, 19, 20, 27, 28) that extend parallel to one another in a lengthwise direction and are aligned adjacent to one another, with their lateral edges (9, 10, 11, 12, 21, 22, 29, 30) being attached to one another via fasteners (15, 16, 17, 18, 25, 26, 33, 34) selected from the group consisting of a sewn seam and adhesive tape, characterized in that the adjacent lateral edges (10, 11, 21, 22, 29, 30) have alternating projections (13, 23, 31) and recesses (14, 24, 32) extending in a transverse direction to the textile web about 50 cm or less, and the web sections (6, 7, 8, 19, 20, 27, 28) are interlocked with one another via these projections (13, 23, 31) and recesses (14, 24, 32), and in that the fasteners (15, 16, 17, 18, 25, 26, 33, 34) connect the projections (13, 23, 31) to one another.

2. Textile web in accordance with claim 1, characterized in that the fasteners (15, 16, 17, 18, 25, 26, 33, 34) extend primarily in a lengthwise direction.

3. Textile web in accordance with claim 1, characterized in that the fasteners (15, 16, 17, 18, 25, 26, 33, 34) are designed to be continuous, without interruption.

4. Textile web in accordance with claim 1, characterized in that the lateral edges (9, 10, 11, 12) have a wave shape.

5. Textile web in accordance with claim 1, characterized in that the lateral edges are zigzag in shape.

6. Textile web in accordance with claim 1, characterized in that the projections (23, 31) are trapezoidal in shape.

7. Textile web in accordance with claim 1, characterized in that the projections are rectangular in shape.

8. Textile web in accordance with claim 1, characterized in that the projections extend in a transverse direction to the textile web between about 10 cm to about 20 cm.

9. Textile web in accordance with one of claim 1, characterized in that the fasteners are designed as sewn seams (15, 16, 17, 25, 26, 33, 34).

10. Textile web in accordance with claim 9, characterized in that to connect two adjacent web sections (7, 8, 19, 20, 27, 28), several parallel sewn seams (15, 16, 17, 25, 26, 33, 34) are used.

11. Textile web in accordance with claim 1, characterized in that the web sections (7, 8, 19, 20, 27, 28) are provided with a support base or are composed thereof.

12. Textile web in accordance with claim 11, characterized in that the support bases are needle punched with carded fibre batt.

13. Textile web in accordance with claim 11, characterized in that the support bases are equipped with a woven textile, a knitted textile, or carded fibre batt, or are composed thereof.

14. Textile web in accordance with claim 11, characterized in that the support bases are provided with synthetic netting.

15. Textile web in accordance with claim 14, characterized in that the synthetic netting is extruded.

16. Textile web in accordance with one of claim 1, characterized in the fasteners are designed as sections of adhesive tape (18).

17. Textile web in accordance with claim 16, characterized in that the sections of adhesive tape cover at least the projections and recesses.

18. Textile web in accordance with claim 16, characterized in that the sections of adhesive tape (18) are designed to be porous.

19. Textile web in accordance with claim 16, characterized in that the sections of adhesive tape (18) contain heat-bonding adhesive, or are composed thereof.

20. Textile web in accordance with claim 16, characterized in that the sections of adhesive tape are designed as bonding sheets with an adhesive coating.

21. Textile web in accordance with claim 16, characterized in that the sections of adhesive tape (18) are designed as spunbonded tissues containing heat-bonding adhesive fibers or are composed thereof.

22. Textile web in accordance with claim 21, characterized in that bonding fibers composed of heat-bonding adhesive are present.

23. Textile web in accordance with claim 21, characterized in that bonding fibers are present, which are designed as bicomponent fibers containing a share of heat-bonding adhesive.

* * * * *